US007438609B2

(12) United States Patent
Yagi et al.

(10) Patent No.: US 7,438,609 B2
(45) Date of Patent: Oct. 21, 2008

(54) METAL TERMINAL

(75) Inventors: Satoshi Yagi, Makinohara (JP); Shigeharu Suzuki, Makinohara (JP); Tetsuro Ide, Makinohara (JP); Hideto Kumakura, Makinohara (JP); Kenji Suzuki, Makinohara (JP); Naoki Kakuta, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/970,009

(22) Filed: Jan. 7, 2008

(65) Prior Publication Data

US 2008/0176458 A1 Jul. 24, 2008

(30) Foreign Application Priority Data

Jan. 18, 2007 (JP) ..... 2007-009131

(51) Int. Cl.
*H01R 4/10* (2006.01)

(52) U.S. Cl. ..... 439/877; 439/741

(58) Field of Classification Search ..... 439/741, 439/421, 423, 877, 878
See application file for complete search history.

(56) References Cited

U.S. PATENT DOCUMENTS 7,201,602 B2 * 4/2007 Kumakura ..... 439/422
7,252,564 B1 * 8/2007 Morello et al. ..... 439/877
7,261,604 B2 * 8/2007 Brake et al. ..... 439/843
7,306,495 B2 * 12/2007 Hashimoto et al. ..... 439/877

FOREIGN PATENT DOCUMENTS

JP 05190214 A * 7/1993

* cited by examiner

*Primary Examiner*—Khiem Nguyen
(74) *Attorney, Agent, or Firm*—Sughrue Mion, PLLC

(57) ABSTRACT

A metal terminal includes a base plate portion for placing an electric wire thereon and a pair of crimping piece portions which extend upwardly respectively from opposite side edges of the base plate portion for press-contacting the electric wire. Each of the crimping piece portions has a distal end portion and a body portion such that a thickness of the each of crimping piece portions is tapered toward a distal end surface of the distal end portion from the body portion. A thickness of a distal end of the distal end portion relative to a board thickness T of the body portion of the each of crimping piece portions is not smaller than ⅕T and is less than ½T. An exterior angle of an angle formed by the distal end surface of the distal end portion and a tapered surface of the distal end portion is 60° to 30°.

2 Claims, 5 Drawing Sheets

METAL TERMINAL

BACKGROUND

This invention relates to a metal terminal to be crimped to an electric wire.

Generally, a metal terminal to be crimped to an electric wire includes a base plate portion for the placing of the electric wire thereon, and a pair of crimping piece portions extending upwardly respectively from opposite side edges of the base plate portion. A crimper of a crimping machine for pressing the pair of crimping piece portions includes a groove having an inner surface formed by a pair of arch-shaped curved surfaces disposed symmetrically (with respect to a central plane of the crimper) in adjoining relation to each other. The pair of crimping piece portions slide respectively on the curved surfaces of the groove in the crimper, and are bent or curved along the respective curved surfaces, and are press-fastened to the electric wire.

There has been proposed one conventional metal terminal in which distal end portions of a pair of crimping piece portions are so shaped as to increase the force (strength) of holding of an electric wire by the crimping piece portions press-fastened to the electric wire (see JP-A-5-190214).

As shown in FIG. 7, in JP-A-5-190214, a tapered surface 53 is formed on an outer side (outer surface) of the distal end portion of each crimping piece portion 51 of the metal terminal 50 in such a manner that an angle θ of the tapered surface 53 relative to a distal end surface 52 is not smaller than 70 degrees. With this configuration, the distal end portion of each crimping piece portion 51 can be easily plastically deformed, and therefore the pair of crimping piece portions 51 can be positively press-fastened to the electric wire so as to increase the wire holding force.

In JP-A-5-190214, when a thickness D of the crimping piece portion 51 at the distal end surface 52 is too small, the wire holding force is reduced. On the other hand, when the thickness D is too large, the crimping piece portion can not be easily plastically deformed. For these reasons, the thickness D is set to about ½ of a plate thickness T of the crimping piece portion 51. However, even when the thickness D at the distal end surface 52 is fixed to ½ of the plate thickness T to thereby increase the angle θ of the tapered surface 53 relative to the distal end surface 52, the amount of change (decrease) in the cross-sectional area of the distal end portion is small, and therefore the amount of plastic deformation of the distal end portion can not be sufficiently increased.

The distal end portions of the pair of crimping piece portions 51 are curved toward each other by the respective curved surfaces of the crimper, and strike against each other at their distal ends. Upon striking of the distal ends against each other, the pair of crimping piece portions 51 exert loads respectively on their mating crimping piece portions 51 so as to further plastically deform the distal end portions toward the electric wire. When the distal end portions of the crimping piece portions 51 curved by the respective curved surfaces of the crimper are not sufficiently plastically deformed, a contact angle obtained upon striking of the distal ends against each other is increased. Furthermore, the contact angle increases with the increase of the angle θ of the tapered surface 53 relative to the distal end surface 52.

When the contact angle between the pair of crimping piece portions 51 is large, the loads mutually acting respectively on the distal end portions do not serve to plastically deform the distal end portions toward the electric wire, so that the crimped shape is unstable. That the crimped shape is unstable means that the stable wire holding force can not be secured.

SUMMARY

This invention has been made in view of the above circumstances, and an object of the invention is to provide a metal terminal capable of securing a stable crimped shape.

The above object has been achieved by a metal terminal of the present invention recited in the following Paragraphs (1) and (2).

(1) A metal terminal includes a base plate portion for placing an electric wire thereon; and a pair of crimping piece portions which extend upwardly respectively from opposite side edges of the base plate portion for press-contacting the electric wire. Each of the crimping piece portions has a distal end portion and a body portion such that a thickness of the each of crimping piece portions is tapered toward a distal end surface of the distal end portion from the body portion. A thickness of a distal end of the distal end portion relative to a board thickness T of the body portion of the each of crimping piece portions is not smaller than ⅕T and is less than ½T. An exterior angle of an angle formed by the distal end surface of the distal end portion and a tapered surface of the distal end portion is 60° to 30°.

(2) The metal terminal of the above Paragraph (1), wherein the crimping piece portions are press-contacted to the electric wire made of a copper alloy and having a cross-sectional area of 0.08 $mm^2$ to 0.13 $mm^2$.

In the metal terminal of the present invention, the distal end portion of each crimping piece portion is formed into the tapered shape, and the thickness of the distal end portion of the crimping piece portion relative to the board thickness T of the body portion is not smaller than ⅕T and is less than ½T. With this configuration, the distal end portion can be easily plastically deformed regardless of the angle formed by the distal end surface of the distal end portion and the tapered surface of the distal end portion, and in addition the exterior angle of the angle formed by the distal end surface and the tapered surface is made smaller (on the order of 60° to 30°) as compared with related metal terminals. Therefore, a contact angle obtained upon striking of the distal ends against each other can be made small, and a stable crimped shape can be secured.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

A preferred embodiment of the present invention will now be described with reference to the drawings.

Figure 1:
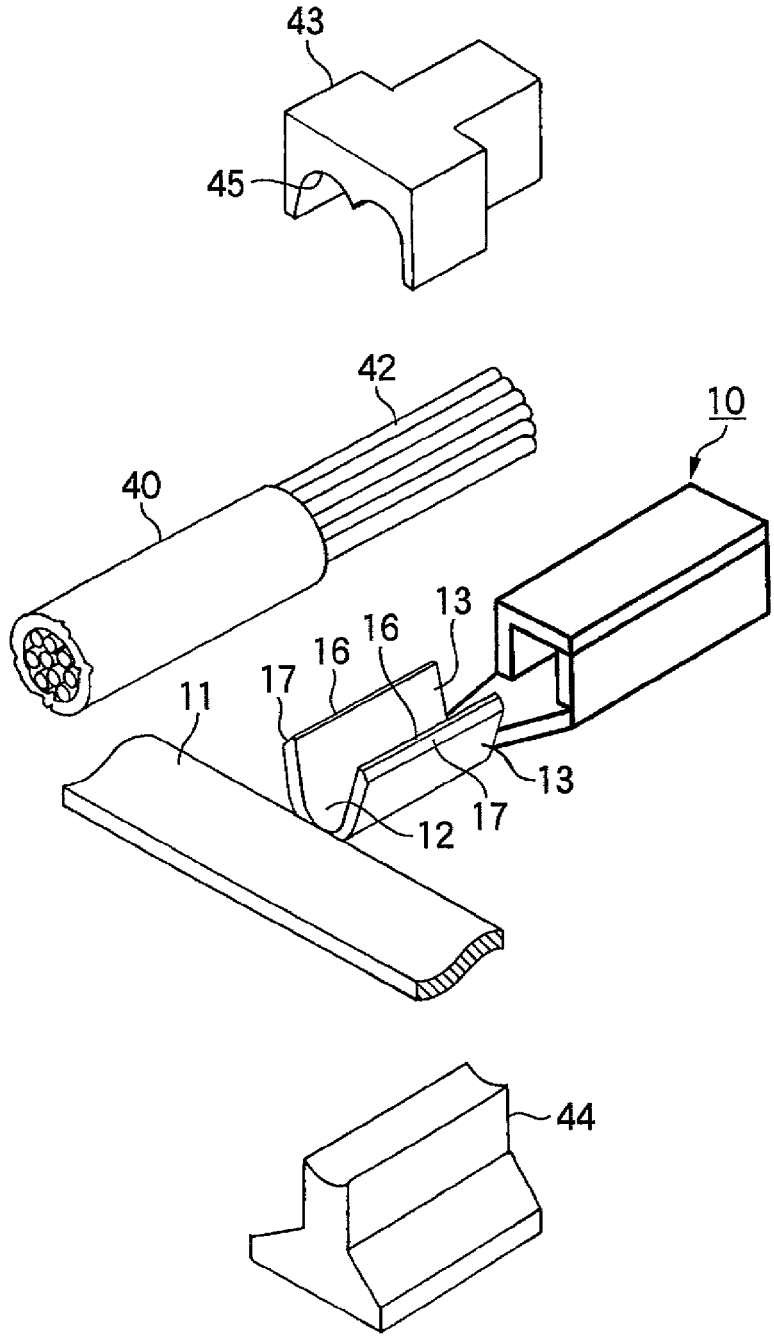
FIG. 1 is a perspective view showing one preferred embodiment of a metal terminal of the present invention, an electric wire to which the metal terminal is to be crimped, and a crimper and an anvil of a crimping machine for crimping the metal terminal to the electric wire.

As shown in FIG. 1, the metal terminal 10 according to one preferred embodiment of the invention is formed from a base sheet (including an electrically-conductive metal sheet) through blanking and bending steps. A plurality of metal terminals 10 are formed at one base sheet, and the plurality of metal terminals 10 formed at the single base sheet are interconnected by an interconnecting piece portion 11 (which is a residual portion remaining after the blanking operation), and these metal terminals 10 interconnected in a chain-like form are sequentially fed to the crimping machine, and then each metal terminal 10 is separated from the remainder after it is crimped to the electric wire.

Each metal terminal 10 includes a base plate portion 12 for the placing of a core wire (conductor) 42 of the electric wire 40 thereon, and this base plate portion 12 is curved into a shape corresponding to a contour of the core wire 42. The metal terminal 10 further includes the pair of crimping piece portions 13 extending upwardly respectively from opposite side edges of the base plate portion 12.

Figure 2:
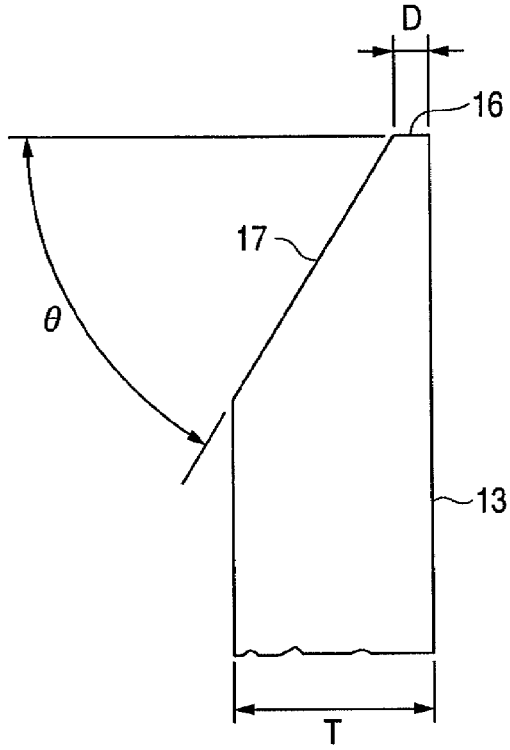
FIG. 2 is a front-elevational view showing a distal end portion of a crimping piece portion of the metal terminal of FIG. 1 on an enlarged scale.

As shown in FIG. 2, the distal end portion of each of the crimping piece portions 13 has a tapered surface 17 formed on an outer surface thereof (facing away from an inner surface thereof opposed to the other (mating) crimping piece portion 13). More specifically, the distal end portion of the crimping piece portion 13 is formed into such a tapering shape that a thickness D of a distal end (projecting end) of the crimping piece portion 13 relative to a plate thickness T of the crimping piece portion 13 except the distal end portion thereof is not smaller than ⅕ T and is less than ½ T and that an exterior angle θ of an angle formed by a distal end surface 16 and the tapered surface 17 is in the range of from 60° to 30°.

Referring again to FIG. 1, the crimping machine for crimping the metal terminal 10 to the core wire 42 of the electric wire 40 includes the anvil 44 for the placing of the base plate portion 12 of the metal terminal 10 thereon, and the crimper 43 disposed in opposed relation to the anvil 44 so as to cooperate with the anvil 44 to press the metal terminal 10 therebetween.

The crimper 43 has a groove formed in that surface thereof opposed to the anvil 44, and an opening of this groove has such a width as to allow the insertion of an upper end portion of the anvil 44 (having the metal terminal 10 supported thereon) into the groove. An inner surface of this groove is formed by a pair of arch-shaped curved surfaces 45 disposed symmetrically (with respect to a central plane of the crimper 43) in adjoining relation to each other.

The crimper 43 is supported on the crimping machine by a vertical movement-effecting mechanism so as to move toward and away from the anvil 44. When the crimper 43 is moved toward the anvil 44, the metal terminal 10 placed on the anvil 44 is received in the groove in the crimper 43.

Figure 3:
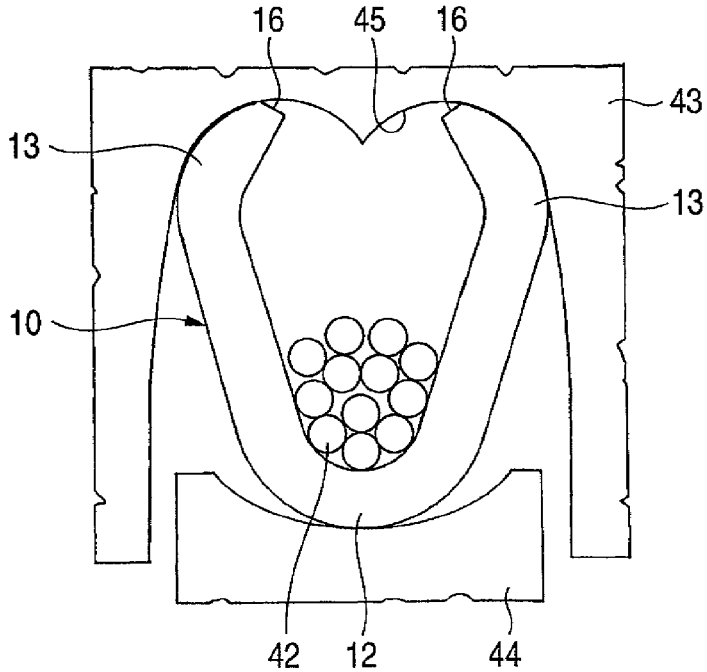
FIG. 3 is a front-elevational view of the metal terminal of FIG. 1 in a front-half stage of a process of crimping the metal terminal of FIG. 1.

As shown in FIG. 3, the pair of crimping piece portions 13 of the metal terminal 10 received in the groove in the crimper 43 abut respectively against the curved surfaces 45 of the groove in the crimper 43, and are pressed by the respective curved surfaces 45, and slide on the respective curved surfaces 45, so that the distal end portions of the two crimping piece portions 13 are curved along the respective curves surfaces 45 toward each other. Here, the distal end portion of each of the crimping piece portions 13 has the tapering shape as described above, and therefore can be easily plastically deformed, and therefore the distal end portion is sufficiently deformed in contiguous relation to the curved surface 45.

Figure 4:
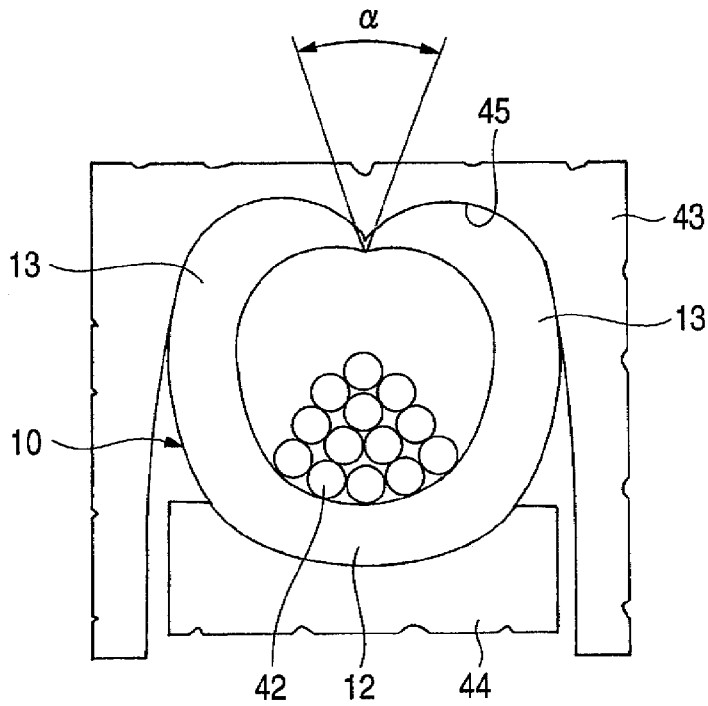
FIG. 4 is a front-elevational view of the metal terminal of FIG. 1 in a latter-half stage of the process of crimping the metal terminal of FIG. 1.
Figure 5:
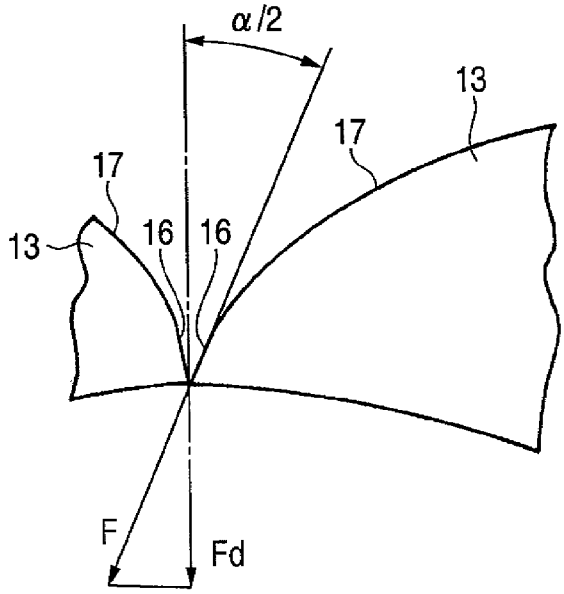
FIG. 5 is a front-elevational view showing the distal end portions of the crimping piece portions of the metal terminal of FIG. 4 on an enlarged scale.

When the crimper 43 is further moved toward the anvil 44 as shown in FIGS. 4 and 5, the pair of crimping piece portions 13 of the metal terminal 10 are further curved, and strike against each other at their distal ends. At this time, the pair of crimping piece portions 13 strike against each other particularly at inner corner portions of their distal ends. Here, a contact angle α between the pair of crimping piece portions 13 is defined as an angle formed by the two distal end surfaces 16 abutting against each other at the inner corner portions.

Upon striking of the distal ends against each other, the pair of crimping piece portions 13 mutually exert forces respectively on their mating crimping piece portions 13 so as to further plastically deform the distal end portions toward the core wire 42. A vector of the load F exerted by one crimping piece portion 13 on the other (mating) crimping piece portion 13 depends on the contact angle α, and a vector of a component force Fd (of the load F) directing the distal end portion toward the core wire 42 is expressed by the formula, $Fd=F\times\cos(\alpha/2)$, and also depends on the contact angle α. Namely, the smaller the contact angle α is, the larger the component force Fd is, and the load F effectively serves to plastically deform the distal end portion of the mating crimping piece portion 13 toward the electric wire. As a result, the crimped shape of the metal terminal 10 is made stable.

EXAMPLES

In order to confirm the advantageous effects of the present invention, crimped shapes of metal terminals different in thickness D of distal ends of crimping piece portions were evaluated.

In the metal terminal of Example 1, the thickness D of the distal end of the crimping piece portion relative to a plate thickness T of the crimping piece portion except the distal end portion formed into a tapering shape is set to ⅕T. In the metal terminal of Example 2, the thickness D of the distal end of the crimping piece portion is set to ¼T. In the metal terminal of Example 3, the thickness D of the distal end of the crimping piece portion is set to ⅓T. In the metal terminal of Comparative Example 1, the thickness D of the distal end of the crimping piece portion is set to ⅙T. In the metal terminal of Comparative Example 2, the thickness D of the distal end of the crimping piece portion is set to ½T.

In the metal terminal of Example 1, an exterior angle θ of an angle formed by a distal end surface of the crimping piece portion and the tapered surface is set to 42.7°. In the metal terminal of Example 2, an exterior angle θ is set to 41.0°. In the metal terminal of Example 3, an exterior angle θ is set to 37.6°. In the metal terminal of Comparative Example 1, an exterior angle θ is set to 44.5°. In the metal terminal of Comparative Example 2, an exterior angle θ is set to 30.0°.

Each of electric wires to which the metal terminals of Examples 1 to 3 and Comparative Examples 1 and 2 are crimped has a core wire (to which the pair of crimping piece portions are press-fastened) made of a copper alloy containing tin (Sn) (The Sn content: about 0.3%), and the cross-sectional area of this core wire is 0.13 $mm^2$.

Figure 6:
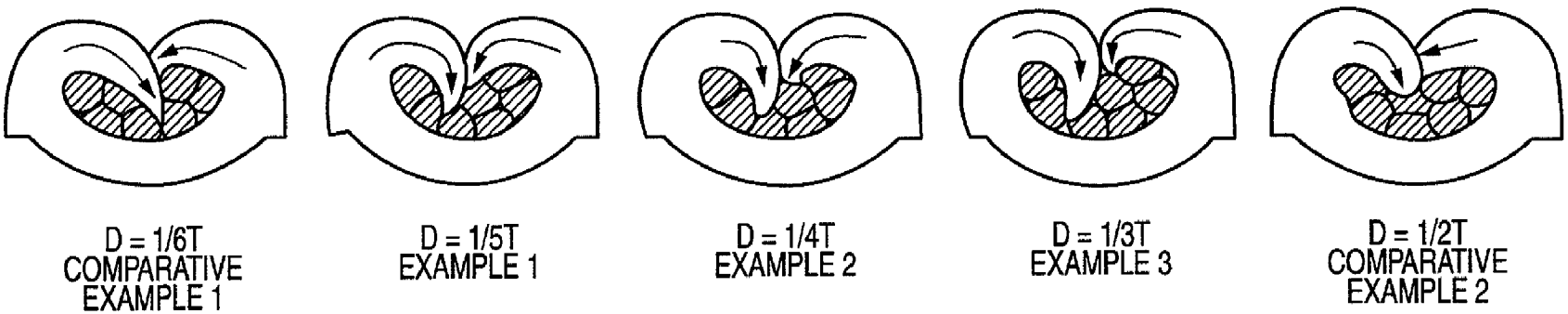
FIG. 6 is a front-elevational view showing crimped shapes of metal terminals of Examples 1 to 3 and Comparative Examples 1 and 2.
Figure 7:
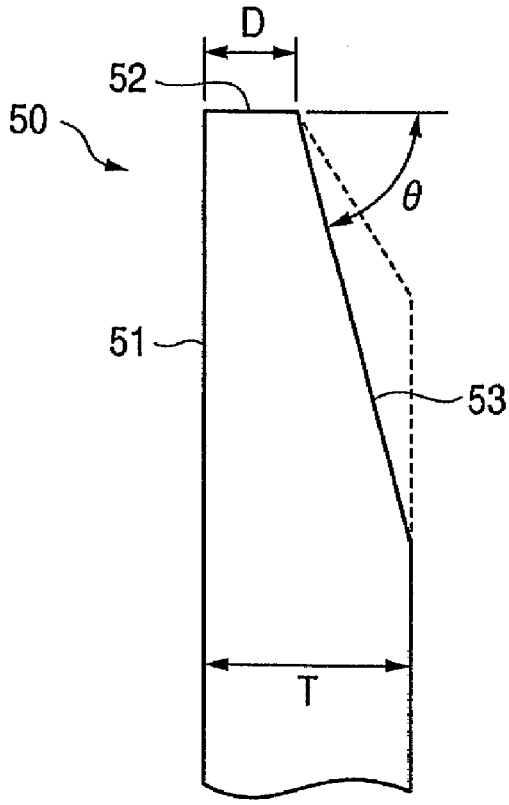
PRIOR ART FIG. 7
FIG. 7 is a front-elevational view showing a distal end portion of a crimping piece portion of a conventional metal terminal on an enlarged scale.

The crimped shapes of the metal terminals of Examples 1 to 3 and Comparative Examples 1 and 2 are shown in FIG. 6.

FIG. 6 is front-elevational view showing the crimped shapes of the metal terminals of Examples 1 to 3 and Comparative Examples 1 and 2.

As is clear from FIG. 6, in the metal terminals of Examples 1 to 3, the pair of crimping piece portions are both bitingly engaged in the core wire of the electric wire, and their crimped shapes are stable. This is due to the fact that the contact angle obtained upon striking of the distal ends of the pair of crimping piece portions against each other is small, so that the loads mutually acting respectively on the distal end portions effectively serve to plastically deform the distal end portions toward the electric wire. On the other hand, in the metal terminals of Comparative Examples 1 and 2, one of the crimping piece portions strikes against the other crimping piece portion, and is prevented by this crimping piece portion from biting into the core wire of the electric wire. This is due to the fact that the contact angle obtained upon striking of the distal ends of the pair of crimping piece portions against each other is large, so that the loads mutually acting respectively on the distal end portions do not serve to plastically deform the distal end portions toward the electric wire. Incidentally, similar results were obtained also in the case of using an electric wire having a core wire whose cross-sectional area was 0.08 $mm^2$.

As described above, in the metal terminal 10, the distal end portion of each crimping piece portion 13 is formed into the tapering shape, and the thickness of the distal end of the crimping piece portion relative to the plate thickness T of the crimping piece portion except the distal end portion is not smaller than ⅕T and is less than ½T. With this configuration, the distal end portion can be easily plastically deformed regardless of the angle formed by the distal end surface 16 of the crimping piece portion and the tapered surface 17, and in addition the exterior angle formed by the distal end surface 16 and the tapered surface 17 is made smaller (on the order of 60° to 30°) as compared with conventional metal terminals. Therefore, the contact angle $\alpha$ obtained upon striking of the distal ends against each other can be made small, and the stable crimped shape can be secured. Incidentally, it is more preferred that the thickness of the distal end of the crimping piece portion is not smaller than ⅕T and is not larger than ⅓T. Also, it is more preferred that the exterior angle of an angle formed by the distal end surface 16 of the crimping piece portion and the tapered surface 17 is about 43° to about 37°.

The present invention is not limited to the above embodiment, and suitable modifications, improvements, etc., can be made. Furthermore, the material, shape, dimensions, numerical value, form, number, disposition, etc., of each of the constituent elements of the above embodiment are arbitrary, and are not limited in so far as the invention can be achieved.

The present application is based on Japan Patent Application No. 2007-009131 filed on Jan. 18, 2007, the contents of which are incorporated herein for reference.

What is claimed is:

1. A metal terminal comprising:

a base plate portion for placing an electric wire thereon; and a pair of crimping piece portions which extend upwardly respectively from opposite side edges of the base plate portion for press-contacting the electric wire, wherein each of the crimping piece portions has a distal end portion and a body portion such that a thickness of the each of crimping piece portions is tapered toward a distal end surface of the distal end portion from the body portion;

wherein a thickness of a distal end of the distal end portion relative to a board thickness T of the body portion of the each of crimping piece portions is not smaller than ⅕T and is less than ½T; and wherein an exterior angle of an angle formed by the distal end surface of the distal end portion and a tapered surface of the distal end portion is 60° to 30°.

2. The metal terminal according to claim 1, wherein the crimping piece portions are press-contacted to the electric wire made of a copper alloy and having a cross-sectional area of 0.08 $mm^2$ to 0.13 $mm^2$.

* * * * *